US006762550B2

(12) United States Patent
Itaya et al.

(10) Patent No.: US 6,762,550 B2
(45) Date of Patent: Jul. 13, 2004

(54) ELECTRODELESS DISCHARGE LAMP

(75) Inventors: Kenji Itaya, Takatsuki (JP); Takeshi Arakawa, Kyoto (JP); Toshiaki Kurachi, Hirakata (JP); Kouji Miyazaki, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/328,313

(22) Filed: Dec. 23, 2002

(65) Prior Publication Data

US 2003/0132706 A1 Jul. 17, 2003

(30) Foreign Application Priority Data

Dec. 28, 2001 (JP) ..... 2001-401790
Feb. 15, 2002 (JP) ..... 2002-038729

(51) Int. Cl.[7] ..... H01J 65/04
(52) U.S. Cl. ..... 313/493; 313/161; 313/634
(58) Field of Search ..... 313/160, 161, 313/573, 493, 44, 634; 315/248, 344

(56) References Cited

U.S. PATENT DOCUMENTS 4,920,297 A 4/1990 van der Heijden et al.
5,130,912 A * 7/1992 Friederichs et al. ..... 362/263
5,726,523 A * 3/1998 Popov et al. ..... 313/161
5,808,414 A * 9/1998 Wharmby et al. ..... 313/607
6,380,680 B1 * 4/2002 Troxler ..... 313/607
2002/0141190 A1 * 10/2002 Matsuba et al. ..... 362/294
2002/0158567 A1 * 10/2002 Arakawa et al. ..... 313/492

FOREIGN PATENT DOCUMENTS

| | | |
|---|---|---|
| EP | 0 704 010 B1 | 9/1999 |
| JP | 62-262302 | 11/1987 |
| JP | 08212981 A | 8/1996 |
| JP | 8-511650 | 12/1996 |
| JP | 09320541 A | 12/1997 |

* cited by examiner

*Primary Examiner*—Vip Patel
*Assistant Examiner*—Glenn Zimmerman

(57) ABSTRACT

An electrodeless discharge lamp with a first coupling member includes a translucent discharge vessel in which a discharge gas is enclosed. A bobbin that includes a coil holding part for an induction coil and a vessel mounting part with a second coupling member is formed as a single piece. The coil holding part holds the induction coil on an outer surface thereof and is placed in proximity to the discharge vessel. The first and second coupling members are complementary and engage to mount the discharge vessel on the vessel mounting part of the bobbin to assure a long life and a positioning accuracy of the discharge vessel and the induction coil thereof.

15 Claims, 7 Drawing Sheets

ELECTRODELESS DISCHARGE LAMP

BACKGROUND OF THE INVENTION (1) Field of the Invention

The present invention relates to an electrodeless discharge lamp that does not include an electrode inside its discharge vessel.

(2) Related Art

These days have seen an increasing use of electrodeless discharge lamps, because of their excellent energy efficiency and long lifespan. The electrodeless discharge lamps are broadly divided into two types: electrodeless fluorescent lamps and high intensity discharge lamps (H.I.D.). In the following, an electrodeless fluorescent lamp is taken as an example, and the structure thereof is described.

In an electrodeless fluorescent lamp, a discharge vessel is placed to be in the proximity of an induction coil, the induction coil being provided on a circuit substrate in an upright position. The discharge vessel is translucent and in which a discharge gas made of a rare gas and mercury is enclosed, and the circuit substrate is stored inside a case so as to be avoided contact of human hands while the lamp is being used.

In most cases, the discharge vessel and the circuit substrate are both attached to the case. In particular, the discharge vessel is attached to the case, with a layer made of heat-resistance silicone in-between.

The silicone used for attaching the discharge vessel to the case will gradually deteriorate; for the silicone layer is subject to the heat from the discharge vessel, when the lamp emits light. Therefore, since electrodeless fluorescent lamps have a significantly longer lifespan compared to conventional fluorescent lamps that have an electrode in their discharge vessel, it is hard for the silicone layer of electrodeless fluorescent lamps to maintain a bonding strength between the discharge vessel and the case, until the last stage of the lifespan. Accordingly, it sometimes happens that the discharge vessel falls off from the case.

In addition, the electrodeless fluorescent lamp described in the above has a structure in which the discharge vessel is coupled to the induction coil, through the mediation of the circuit substrate, the case, and the like. According to this structure, assembly variations will occur at the time of assembling the parts together, besides the variations of size for individual parts. Accordingly, it sometimes happens that the position between the discharge vessel and the induction coil deviates from as designed. When the relative position between the discharge vessel and the induction coil deviates, the problem arises that the luminous performance differs according to an area of the discharge vessel.

A technology has been proposed by the Japanese Laid-open Patent Application No. H09-320541 for coping with the above mentioned problem. In this patent application, a case is provided with a convex portion that is used to couple the discharge vessel to the case; and a corresponding concave portion is provided on the corresponding area of the discharge vessel. The discharge vessel will be coupled to the case, by fitting the convex portion to the concave portion.

For the electrodeless fluorescent lamp produced using the above technology, the discharge vessel will be prevented from falling off at the later stage of lifespan, and the deviation in relative position between the discharge vessel and the case is reduced to a minimum.

However, in the method of coupling the discharge vessel to the case, in order to fit the convex portion to the concave portion, a force is to be exerted on the discharge vessel and on the case. This means that a force will be exerted on a discharge vessel which is made of glass. For assuring strength and accuracy in mounting the discharge vessel to the case, it becomes necessary to have a smaller clearance between the concave portion and the convex portion, which further increases a force that the discharge vessel is subject to. In some cases, this leads to a break of the discharge vessel or the case.

As mentioned in the above, for the electrodeless fluorescent lamp produced using the disclosed technology, the accuracy in position between the discharge vessel and the case is assured; however, the accuracy in position between the discharge vessel and the induction coil (which is an important factor in assuring the uniform luminous performance throughout the entire luminous area) will not be assured. This is due to the structure of this electrodeless fluorescent lamp, in which its discharge vessel and induction coil are attached to each other, through a mediation such as the circuit substrate and the case. Therefore, the positioning accuracy of the discharge vessel and the induction coil will be hindered, as much as an accumulation of various kinds of deviations yielded at the time of producing and assembling the mediation parts.

Considering the above, it can be said that the disclosed technology is not for practical use.

SUMMARY OF THE INVENTION

The object of the present invention, in order to solve the stated problems, is to provide an electrodeless fluorescent lamp whose discharge vessel is prevented from falling off, and that delivers a uniform luminous performance throughout the entire luminous area by assuring an accuracy in position between a discharge vessel and an induction coil.

In order to achieve the above object, the electrodeless discharge lamp of the present invention is characterized by having a translucent discharge vessel in which a discharge gas is enclosed, the discharge vessel having a first coupling member; an induction coil; and a bobbin that includes a coil-holding part and a vessel-mounting part that are formed as a single piece, the vessel-mounting part having a second coupling member, where the coil-holding part holds the induction coil on an outer surface thereof, and is placed in a proximity of the discharge vessel, and the first coupling member and the second coupling member are coupled so as to mount the discharge vessel on the vessel-mounting part of the bobbin.

The electrodeless discharge lamp according to the present invention has a discharge vessel that is mechanically coupled by the second coupling member of the vessel-mounting part. Accordingly, the discharge vessel will be prevented from falling off, over a long period of time.

In addition, in the above-mentioned conventional electrodeless discharge lamp, it is difficult to maintain a positioning accuracy between its discharge vessel and induction coil, since the discharge vessel and the induction coil are coupled to each other, with a plurality of parts in-between. Whereas in the electrodeless discharge lamp of the present invention, the coil-holding part and the vessel-mounting part are formed as a single piece, where the coil-holding part holds the induction coil, and the vessel-mounting part coupling the discharge vessel to the bobbin. According to the above structure, the electrodeless discharge lamp of the present invention realizes a high positioning accuracy between the discharge vessel and the induction coil in the mounting process. At the same time, the relative position between the discharge vessel and the induction coil will not vary, according to a heat generated from the discharge vessel at the time of the lamp being used.

Accordingly, the electrodeless discharge lamp according to the present invention will assure a uniform luminous performance throughout its luminous area, and will not be subject to a damage that would happen due to the induction coil coming in contact with the discharge vessel during the transportation of the lamp, between the shipping of the lamp to the setting thereof, for example.

In the stated electrodeless discharge lamp, it is desirable to have a structure in which one of the first coupling member and the second coupling member is a protrusion, and the other is a groove that is shaped to receive the protrusion is desirable, in order to produce the lamp with ease, and that to mount the discharge vessel with a high positioning accuracy.

In the stated electrodeless discharge lamp, the discharge vessel is desirably coupled to the vessel-mounting part so that the discharge vessel is held in a fixed position, in order to further increase the positioning accuracy between the discharge vessel and the induction coil.

In the stated electrodeless discharge lamp may further have the following structures: a structure in which a distance between a groove bottom and a center of the vessel-mounting part continuously decreases in a diameter direction, the groove bottom being a part of an inner surface of the bottom that is under the groove, and the protrusion of the discharge vessel is guided toward a center of the vessel-mounting part in a diameter direction by being rotated along the groove bottom, so as to eventually hold the discharge vessel in a fixed position; and a structure in which the groove is formed along the inner wall so as to continuously decrease in height, and the protrusion of the discharge vessel is guided toward a height direction of the groove formed on the vessel-mounting part, by being rotated along the part of the inner wall, so as to eventually hold the discharge vessel in a fixed position. These structures are desirable in view of assuring the positioning accuracy between the discharge vessel and the induction coil. These structures are also advantageous in that a large force is not necessary in coupling the discharge vessel.

Here, the discharge vessel may be rotated leftward when the vessel-mounting part is seen from the discharge vessel. This is an opposite direction to the rightward direction in which the lamp is rotated when setting the lamp.

Generally speaking, in taking off the electrodeless discharge lamp at the last stage of its lifespan, the lamp is made to be loose, by rotating the lamp in a leftward direction. Considering the above, it is advantageous to couple the discharge vessel by a leftward rotation, since at the time of taking off the lamp having ended its life through a leftward rotation, the discharge vessel will be further fastened to the vessel-mounting part. This will prevent the discharge vessel from falling off from the vessel-mounting part.

In the above described electrodeless discharge lamp, the discharge vessel may be held in a fixed position, by being directly coupled to the vessel-mounting part, or by means of a member made of a resin material in-between, such as silicone and epoxy.

BRIEF DESCRIPTION OF THE DRAWINGS

These and other objects, advantages and features of the invention will become apparent from the following description thereof taken in conjunction with the accompanying drawings that illustrate a specific embodiment of the invention. In the drawings.

DESCRIPTION OF THE PREFERRED EMBODIMENTS (The First Embodiment)

Figure 1:
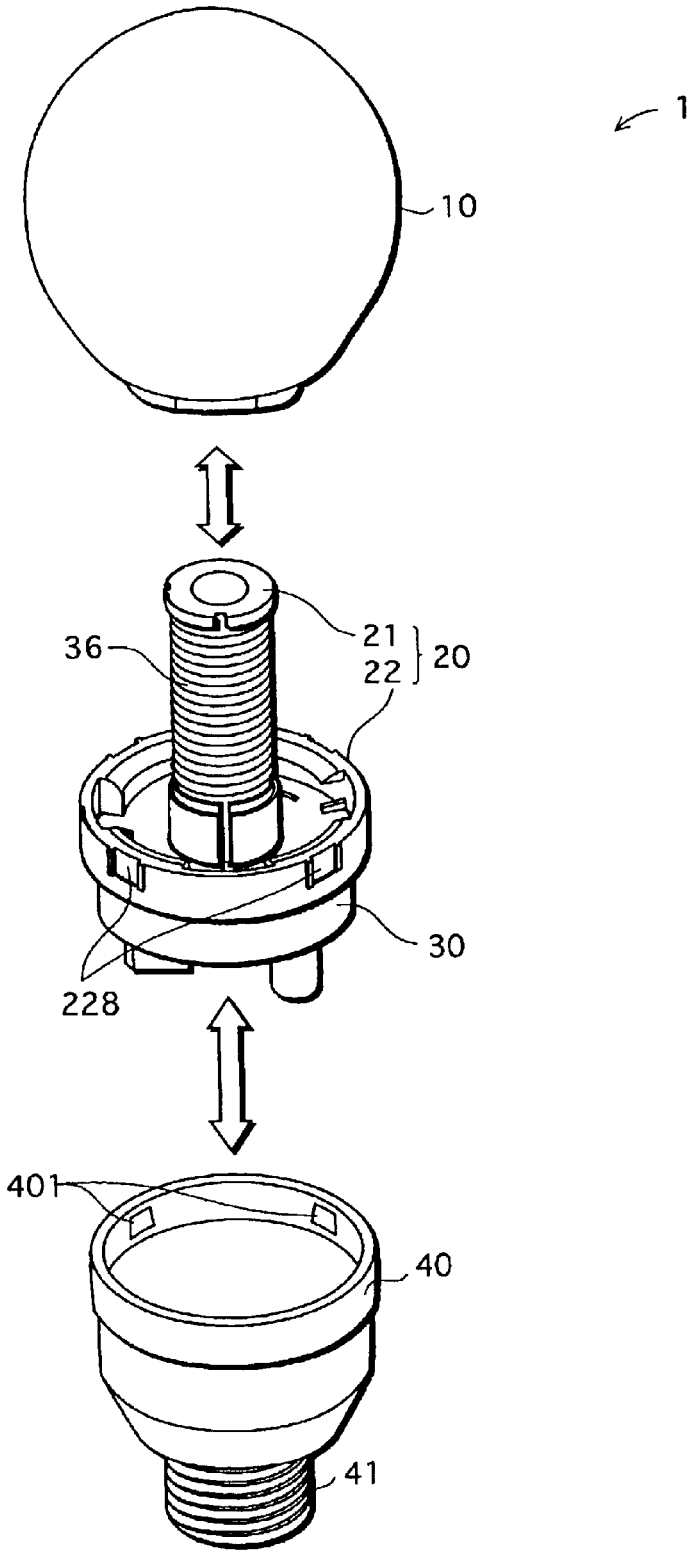
FIG. 1 is an exploded perspective view of an electrodeless fluorescent lamp 1 that relates to the first embodiment.

The first embodiment of the present invention is described in the following, with reference to FIG. 1. FIG. 1 is an exploded perspective view of an electrodeless fluorescent lamp 1 which relates to the first embodiment. As shown in FIG. 1, the electrodeless fluorescent lamp 1 of the first embodiment is made up of a discharge vessel 10, a bobbin 20 to which a heat sink member 30 is fixed, and a case 40.

The bobbin 20 includes a coil-holding part 21 and a vessel-mounting part 22 that are formed as a single piece using one resin material. The coil-holding part 21 is in a tubular shape and holds an induction coil 36, and the discharge vessel 10 is coupled to the vessel-mounting part 22. The heat sink member 30 is fixed to one surface of the vessel-mounting part 22, the surface being opposite to the other surface from which the coil-holding part 21 outstands.

Further, the coil-holding part 21 is inserted into a hollow 13 (not shown in FIG. 1, see FIG. 2), the hollow 13 being provided in the center of the discharge vessel 10.

The heat sink member 30 is integrally formed with a core-supporting member 31 in a tubular form and a base member 32, both of which are made of a metal material. The heat sink member 30 is fixed to the bobbin 20 in such a manner that the core-supporting member 31 is inserted into the coil-holding part 21. The heat sink member 30 is used for liberating heat from the ferrite core 35 (not shown in FIG. 1) and from the induction coil 36, at the time when the lamp emits light.

On a surface of the base member 32, which is opposite to the surface where the core supporting member 31 is provided to outstand, a circuit-mounted member is provided that includes a high frequency oscillating circuit and a rectifier, and the like. None of the circuit-mounted member, the high frequency oscillating circuit, and the rectifier is shown in FIG. 1.

The case 40 is in a funnel-like shape, and covers the heat sink member 30 so that the circuit-mounted member is kept from contact of human hands while the lamp is used. At the lower end of the case 40, a screw base 41 is fixed. The screw base 41 is used for fixing the lamp to a luminaire, and also for connecting the lamp to an external power source. The screw base 41 is made of an electrically conductive metal. On the surface area of the screw base 41, a screw member (right-hand thread) is formed for fixing the lamp to the luminaire.

The bobbin 20 and the case 40 are fixed to each other, by fitting the convex portion 401 provided on an inner surface of the upper side of the case 40, to the concave portion 228 provided on an outer surface of the side of the vessel-mounting part 22.

Figure 2:
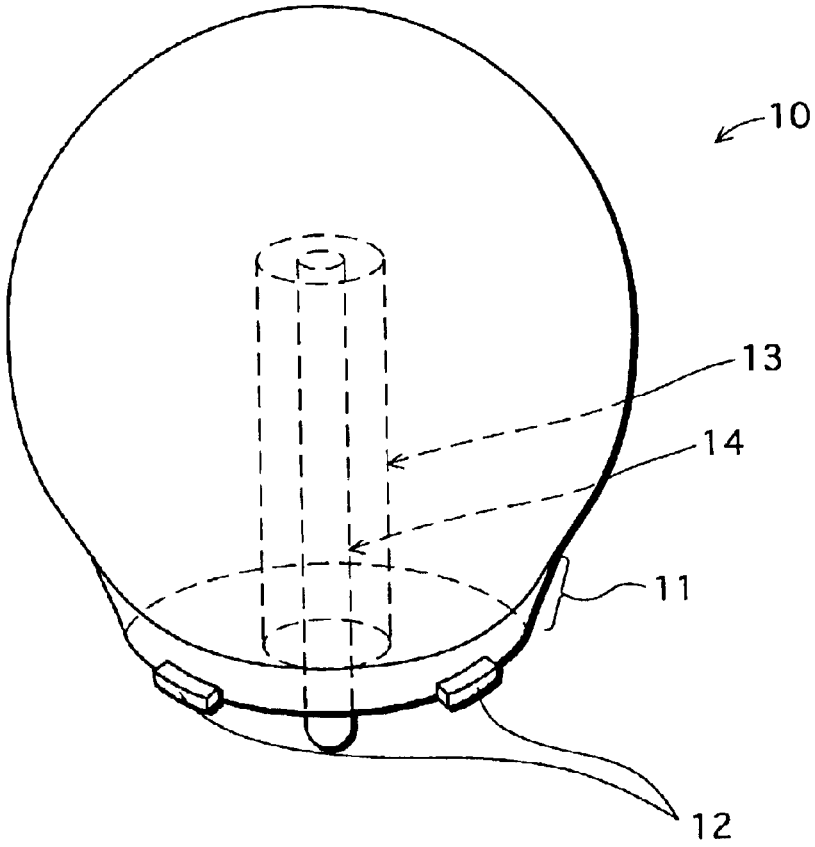
FIG. 2 is a perspective diagram of the discharge vessel shown in the above FIG. 1.

The following is a description on the structure of the discharge vessel 10, with reference to FIG. 2.

As shown in FIG. 2, the discharge vessel 10 is substantially spherical in shape and is made of a translucent material. On the lower end part of the discharge vessel 10, a neck portion 11 is formed which has a shorter diameter compared to the other parts of the discharge vessel 10.

A hollow 13 is formed in a cylinder-like shape through the neck portion 11 of the discharge vessel 10, and elongates toward the center of the discharge vessel 10. Inside the hollow 13, a thin tube portion 14 is formed to elongate toward an outside direction of the discharge vessel 10 (toward the lower direction in the example of FIG. 2).

In addition, four protrusions 12 are respectively formed on four outside surface areas of the neck portion 11, each protrusion 12 outstanding outwardly in the diameter direction of the discharge vessel 10. FIG. 2 shows two protrusions thereof.

The discharge vessel 10 has a phosphor layer on its inner wall (not shown in FIG. 2). In the space inside the discharge vessel 10, a discharge gas that is a mixture of mercury and a rare gas is enclosed.

For the discharge vessel 10 having the above structure, the protrusions 12 of the neck portion 11 are formed as follows: first, the neck portions 11 are heated up to the softening point, using a burner for example, then molds are placed to sandwich the neck portion 11, the molds being shaped to have portions formed to correspond to the form of the protrusions 12.

Figure 3:
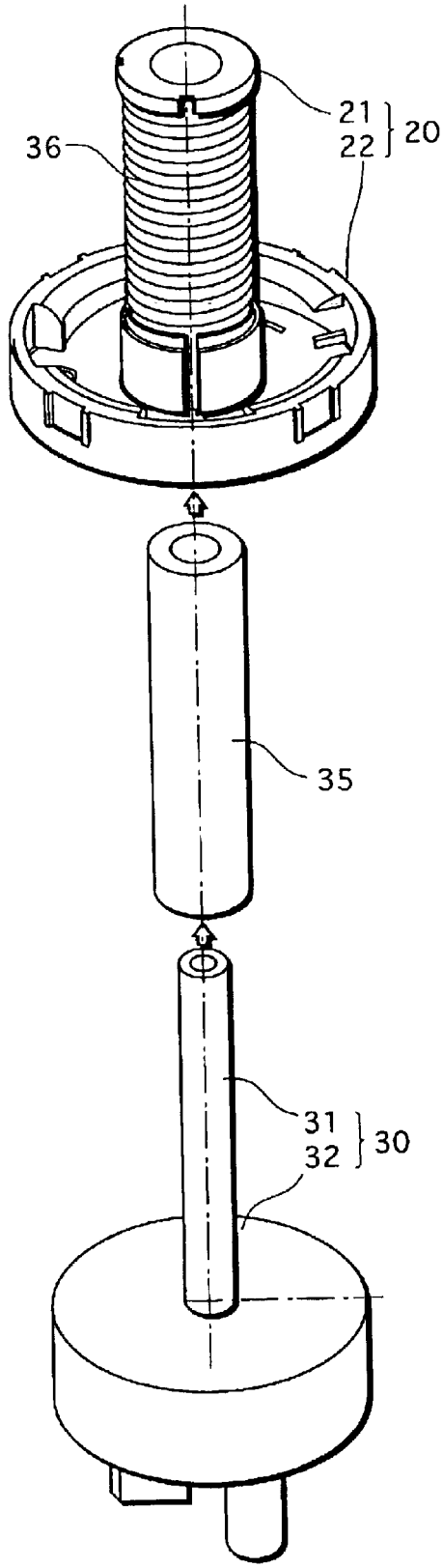
FIG. 3 is an exploded view showing how a bobbin, a ferrite core, and a heat sink member are linked.

Next, the structure relating to the peripheral parts of the bobbin 20, and the fixing of the heat sink member 30 to the bobbin 20 are described, with reference to FIG. 3.

As shown in FIG. 3, a ferrite core 35 is inserted in a through-hole formed through the middle of the coil-holding part 21, the ferrite core 35 being tube-shaped and having an outer diameter which is slightly smaller than the inner diameter of the through-hole of the coil-holding part 21. Please note that a heat-resistance white tape (not shown in FIG. 3) is wound around the outer surface of the induction coil 36 that is held around the coil-holding part 21, the outside surface of the induction coil 36 being which faces the inner wall of the hollow 13 when assembled. Thanks to this heat-resistance white tape, visible light converted by means of the phosphor layer will be prevented from being absorbed through the induction coil 36 inserted in the middle of the discharge vessel 10, and is guided to the outside of the lamp.

Note that as long as the above effect is achieved, the heat-resistance white tape which is described in the above is replaceable with any means. For example, in order to reflect visible light, a white tube may be used to cover the induction coil 36, or a heat-resistance white paint may be applied to the induction coil 36 so as to form a paint-layer. Examples of the materials which may be used therefor include: silicone, polytetrafluoroethylene, and poly-imide-amide.

In addition, the light-reflective layer may be also formed as follows, in place of applying the heat-resistant white paint. Firstly, powders made from such as alumina and silica are mixed with a binder, then the powders are applied to the surface of the induction coil 36, and finally a layer is formed by firing the powders on the induction coil 36.

Further, the core-supporting member 31 of the heat sink member 30 is inserted in a through-hole of the ferrite core 35, the through-hole being formed through the middle of the ferrite core 35 in its diameter direction.

Although not shown in FIG. 3, for connecting the induction coil 36 with the circuit mounting member which is fixed to the heat sink member 30, a lead wire (not shown in FIG. 3) is used which is inserted in a hole that is provided through the bobbin 20 and the base member 32 of the heat sink member 30.

Figure 4:
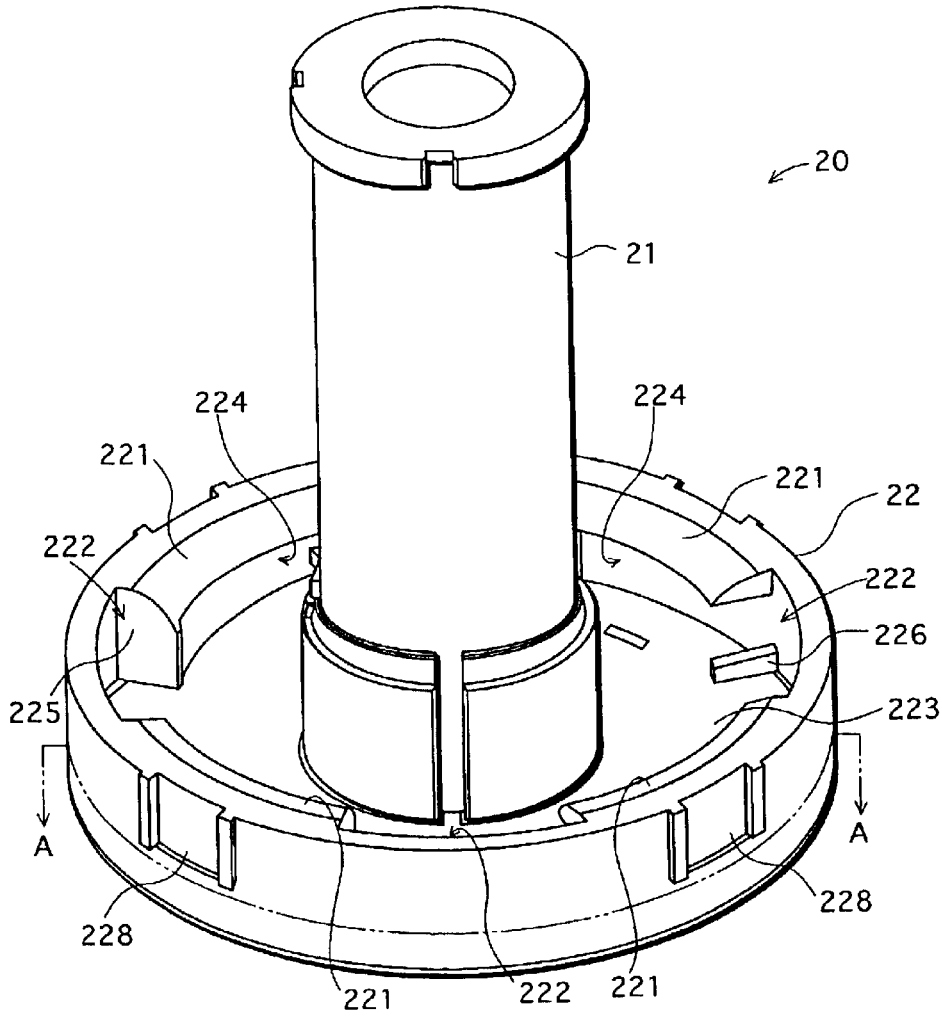
FIG. 4 shows a perspective view of the bobbin.

Next, the structure of the bobbin 20 which is a character part of the present invention is described, with reference to FIG. 4.

In reality, the coil-holding part 21 and the vessel-mounting part 22 are formed as a single piece using a same resin material. Examples of the resin material are such as a polyphenylene sulfide (PPS) resin, and a liquid crystal polymer, that have a high heat-resistance.

As shown in FIG. 4, the vessel-mounting part 22 is a shallow dish which has a bottom and an upright brim portion. Four walls 221 are formed around the top surface of the brim portion of the shallow dish. Each wall 221 elongates toward inside of the diameter direction of the shallow dish. An outer surface of each wall portion is processed to be curved, so as to coincide with the curved form of the outer surface of the discharge vessel 10.

As a result of the four walls 221 being formed, four grooves 224 are each formed between each of the walls 221 and the bottom surface 223 of the vessel-mounting part 22.

In addition, four portions 222 are respectively cut away from between each neighboring wall 221 to form four cut-out portions 222. The cut-out portions 222 are formed to enable the protrusions 12 to be freely inserted into the grooves 224 without being disturbed by the walls 221, at the time when the coil-holding part 21 is inserted into the hollow 13 of the discharge vessel 10, and the neck portion 11 of the discharge vessel 10 is inserted into the vessel-mounting part 22 of the bobbin 20.

Further, both ends of each wall 221, which are next to the cut-out portions 222, are provided with a prevention wall 225 and a rising portion 226, respectively. Each prevention wall 225 is formed to connect the bottom surface 223 and the wall 221, and is formed at the left end of each wall 221, when the bobbin 20 is seen in its plan view.

On the other hand, each rising portion 226 is formed under the right end of each wall 221, when the bobbin 20 is seen in its plan view. The rising portion 226 outstands from the bottom surface 223 and has a height which is the same as the thickness of the protrusion 12 of the discharge vessel 10, so as to prevent the discharge vessel 10 from being slipped off by reverse-rotation, after the discharge vessel 10 has been coupled to the vessel-mounting part 22.

Around the outer side surface of the brim portion of the vessel-mounting part 22, four concave portions 228 are formed, for fixing the case 40, as mentioned in the above.

Figure 5:
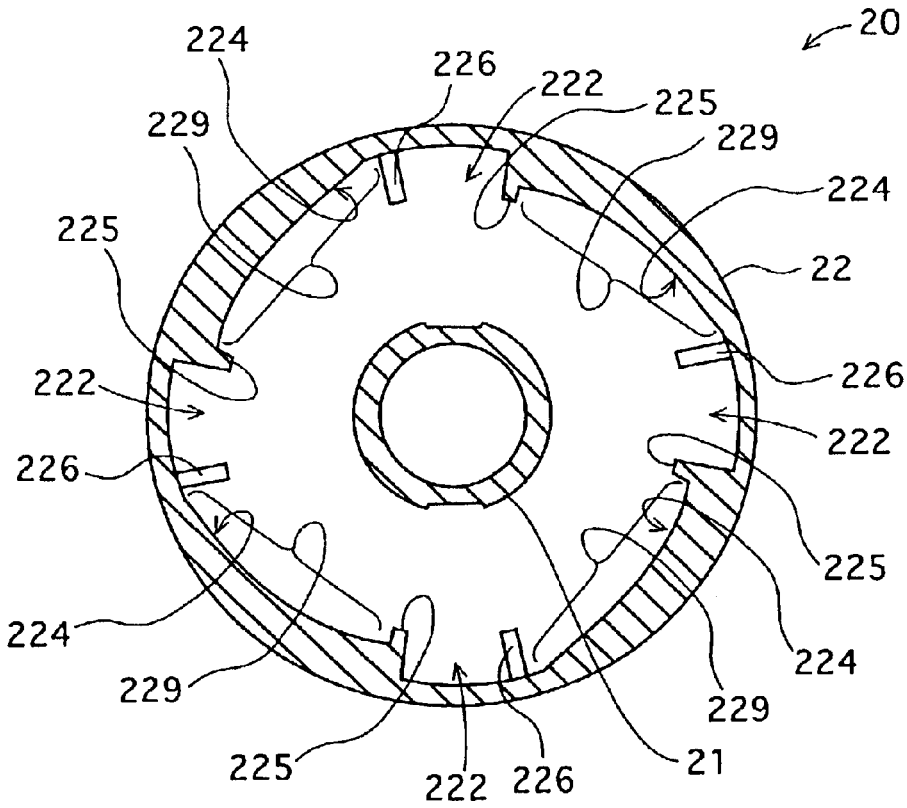
FIG. 5 shows a fragmentary sectional view of a vessel-mounting part that is taken along the line A—A.

The following is a description of the specific form of the groove 224, with reference to FIG. 5. FIG. 5 is a sectional view taken along the line A—A of FIG. 4, and shows a sectional view of the vessel-mounting part 22, taken at a substantially middle portion of an summation of the height of the wall 221 and the thickness of the bottom portion (that includes the bottom surface 223).

As shown in FIG. 5, the outer surface of the vessel-mounting part 22 is round in shape. In the middle of the vessel-mounting part 22, a coil-holding part 21 that is in a tube-shape is formed.

As already mentioned, the prevention wall 225 and the rising portion 226 are formed on inside of the side wall of the vessel-mounting part 22, both being elongated toward inward direction of the diameter.

A groove bottom 229 that is a part of the bottom surface 223 and is under the groove 224 is in a taper-like shape, so as to gradually reduce a clearance formed in a diameter direction between the protrusion 12, at the time when the discharge vessel 10 is being rotated. The groove bottom 229 is formed so that the clearance will disappear at a place where the side surface of the protrusion 12 of the discharge vessel 10 comes into collision with the prevention wall 225.

The following describes how the discharge vessel 10 is coupled to the vessel-mounting part 22 that has the above structure.

First, the coil-holding part 21 of the bobbin 20 is inserted into the hollow 13 of the discharge vessel 10, until the protrusion 12 of the discharge vessel 10 reaches the groove 224. Note here, that the protrusion 12 has to pass through the cut-out portion 222, before reaching the groove 224. In addition, the depth that the discharge-vessel 10 should go in the bobbin 20 is deeper than the wall 221, and shallower than the upper surface of the rising portion 226.

Next, the discharge vessel 10 is rotated in the leftward direction, until the protrusion 12 passes through the rising portion 226, then a bottom surface of the protrusion 12 of the discharge vessel 10 is fitted to the bottom surface 223 of the vessel-mounting part 22 (the bottom surface 223 not shown in FIG. 5).

Further, the discharge vessel 10 is rotated in the leftward direction, while keeping the bottom surface of the protrusion 12 fitted to the bottom surface 223 of the vessel-mounting part 22. As the discharge vessel 223 rotates, a protrusion 12 that positions farthest in the diameter direction comes into contact with the groove bottom 229, and slides along the groove bottom 229. By this process, the protrusion 12 is guided, along the groove bottom 229, toward the center in the diameter direction of the vessel-mounting part 22. Eventually, the centering between the discharge vessel and the vessel-mounting part 22 is realized as a result of all the four protrusions 12 coming into contact with the respective groove bottoms 229. By this process, the position of the discharge vessel 10 relative to the bobbin 20 in the diameter direction is determined with high level of accuracy.

Further, as also for the height direction, the position of the discharge vessel 10 relative to the vessel-mounting part 22 is determined with reliability, since the protrusion 12 is fitted to the bottom surface 223 of the vessel-mounting part 22, while the protrusion 12 is being rotated.

In the above way, the discharge vessel 10 will be finally caught by the vessel-mounting part 22, by being rotated until the side surface of the protrusion 12 comes into collision with the prevention wall 225. At this moment, the clearance between the protrusion 12 of the discharge vessel 10 and the groove bottom 229 of the groove 224 disappears, as already mentioned. In other words, the groove bottom 229 of the groove 224 is formed so as to cease to have a clearance between the protrusion 12, when the side surface of the protrusion 12 comes into collision with the prevention wall 225.

Here, it is important to make sure that the discharge vessel 10 is coupled, by being rotated until the protrusions 12 come into collision with the respective prevention walls 225. However, in the coupling process, care should be taken so as not to impose too much stress on the discharge vessel 10. That is, it is desired that the characteristic value for the strength of the discharge vessel 10 is known in advance, so as to be able to perform coupling with the adequate torque calculated based on the value. If the torque generated at the time of rotation is too large, the discharge vessel will be subject to too much stress, while if the torque is too small, a large clearance is generated between the discharge vessel 10 and the vessel-mounting part 22, which will lead to an inaccurate positioning therebetween.

Note here that the torque will vary depending on the material and the thickness. Therefore individual adjustment is required.

Figure 6:
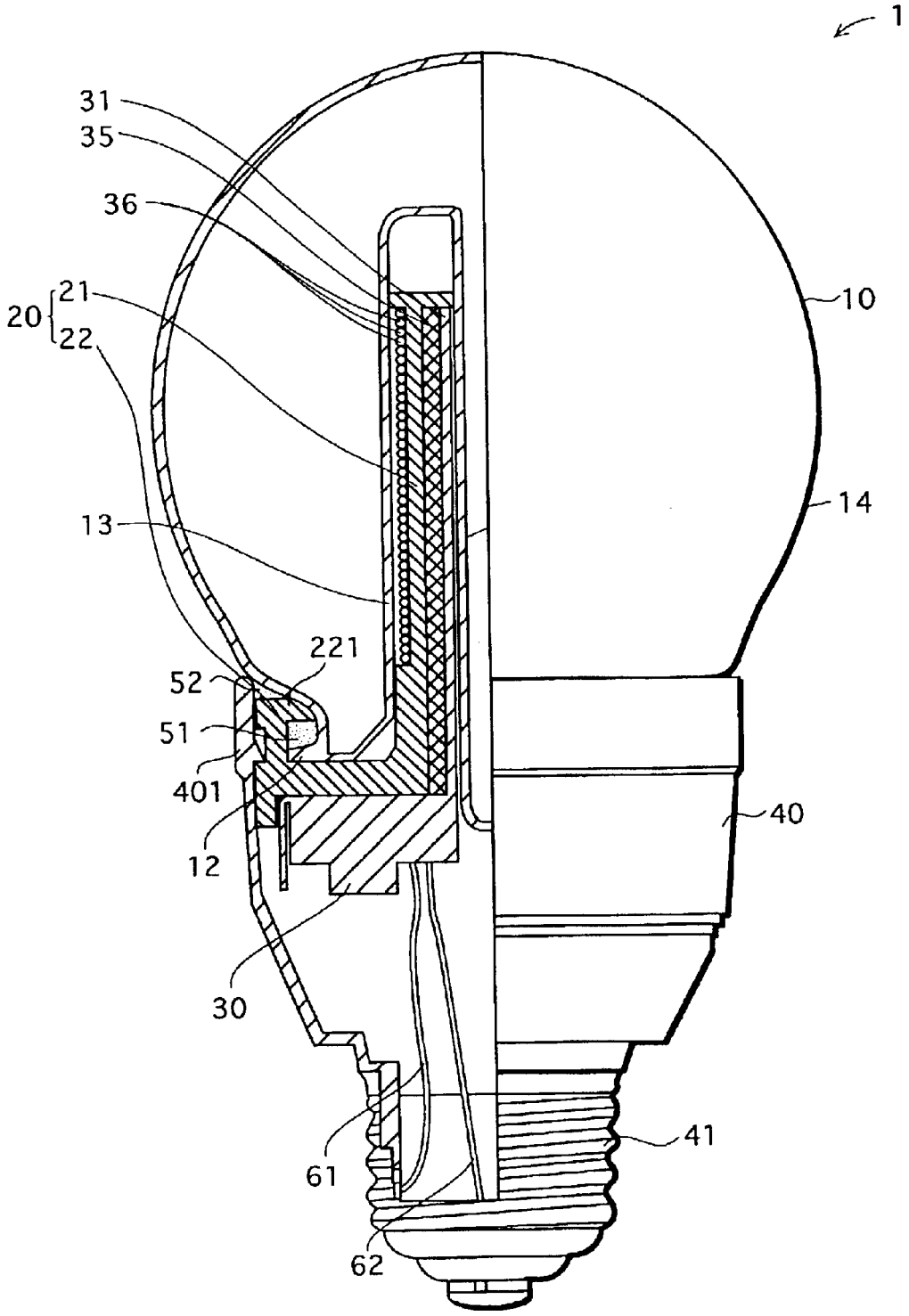
FIG. 6 is a diagram showing a general view of the electrodeless fluorescent lamp after having been assembled, (a part of which is a sectional view to show inside)

In a clearance generated between the discharge vessel 10 and the vessel-mounting part 22, which have been mechanically coupled to each other, heat-resistant silicone is injected and then heated, so as to form a silicone layer 51 (refer to FIG. 6). The silicone layer 51 helps fix the discharge vessel 10 to the vessel-mounting part 22, with reliability. The silicone layer 51 also plays a role of avoiding an entry of the water into the area that is provided with the induction coil 36.

As shown in FIG. 6, the case 40 is fixed to the vessel-mounting part 22, after the discharge vessel has been coupled to the vessel-mounting part 22. A heat-resistance silicone layer 52 is also formed in a gap generated between the vessel-mounting part 22 and the case 40. The reason why the silicone layer 52 is formed in this place is to prevent an entry of water and the like in the case 40, in an attempt to prevent a short and the like that would otherwise occur on the circuit substrate that is fixed to the heat sink member 30.

The wirings 61 and 62 are provided so as to connect the screw base 40 of the case 40 with the circuit substrate of the heat sink member 30.

(Excellence of the Electrodeless Fluorescent Lamp 1)

Usually, a clearance is formed between the hollow 13 of the discharge vessel 10 and the coil-supporting member 21 of the bobbin 20. However, in the electrodeless fluorescent lamp 1, the discharge vessel 10 is coupled to the bobbin 20 with high positioning accuracy. Therefore, the hollow 13 will not come into contact with the coil-supporting member 21, at the time of transporting the lamp, for example. Accordingly, the hollow 13 and the thin tube portion 14 will be avoided from being damaged.

Furthermore, in conventional electrodeless fluorescent lamps, a discharge-vessel is attached to the case by means of an adhesive and the like. This makes it difficult, in the production process, to assure accuracy in positioning between the induction coil and the discharge vessel. Accordingly, the luminous performance tends to differ according to each luminous area of the lamp. Further, with conventional electrodeless fluorescent lamps, it sometimes happened that the phosphor layer formed inside the hollow that is created in the middle of the discharge vessel 10 tends to change its color into black (i.e. solarization), which is due to the hollow being too close to induction coil.

The electrodeless fluorescent lamp 1 in the above can coop with the stated problems by the structure of mechanically coupling the discharge vessel 10 and the bobbin 20. As a result, the high accuracy in positioning between the discharge vessel 10 and the induction coil 36 is achieved, which realizes a uniform luminous performance throughout the entire luminous area.

Further, from the same reason, for the electrodeless fluorescent lamp 1, the discharge-vessel 10 is avoided from falling off, which would occur due to the deterioration of the silicone layer after the lamp has been used over a long time.

In addition, for the electrodeless fluorescent lamp 1, while turning the lamp in a leftward direction, so as to remove the lamp from the luminaire at the end of the life of the lamp, the discharge vessel 10 will remain tightened to the bobbin 20, since the discharge vessel 10 is coupled to the bobbin by a leftward rotation. Therefore, the discharge vessel 10 will not fall off from the bobbin 20. This means that the electrodeless fluorescent lamp is excellent in safety point of view at the time of operation.

(The Second Embodiment)

In the first embodiment described above, the electrodeless fluorescent lamp 1 has an excellent characteristics in assembly accuracy, safety level in operating the lamp, and the like, by having the structure of mechanically coupling the discharge vessel 10 directly to the vessel-mounting part 22 of the bobbin 30. In the following, the electrodeless fluorescent lamp 2 is described that is assured to have a high assembly accuracy without being susceptible to the forming accuracy of the discharge vessel 10, with reference to FIG. 7.

Figure 7:
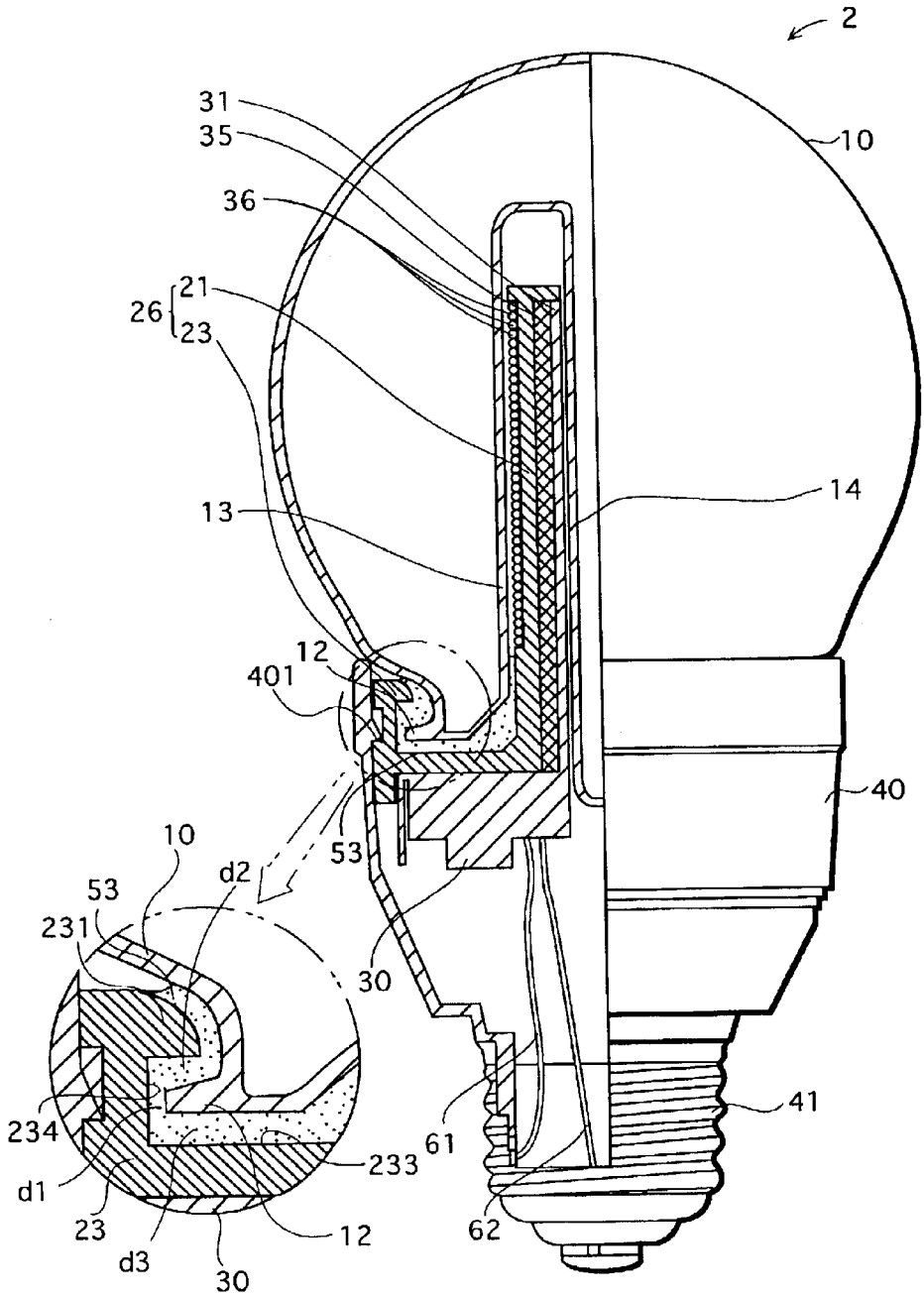
FIG. 7 is a diagram showing a general view of an electrodeless fluorescent lamp according to the second embodiment (a part of which is a sectional view to show inside).

The difference between the electrodeless fluorescent lamp 2 of FIG. 7 and the electrodeless fluorescent lamp 1 in the first embodiment is in the form of a bobbin 26, in particular in the form of a vessel-mounting part 23. Accordingly, the same reference numbers are used for the other parts that are the same as those in the first embodiment, and the explanation thereof will not be done in the present embodiment.

As shown in FIG. 7, the vessel-mounting part 23 is formed a wall 231 that extends from an upper portion of the side wall thereof, so as to form a groove 234 which is wider than that of the vessel-mounting part 22. The distance from the bottom surface 233 to the wall 231, (i.e. the height of the groove 234) may either be the same as, or larger than the height of the groove 224 of the electrodeless fluorescent lamp 1.

Clearances d1, d2, and d3 are formed between the protrusion member 12 of the discharge vessel 10 and the groove 234 of the vessel-mounting part 23. A heat-resistance silicone layer 53 is provided in each of the clearances d1, d2, and d3. Through this silicone layer 53, the discharge vessel 10 is coupled to the vessel-mounting part 23. Here, note that the silicone layer 53 is formed inside the vessel-mounting part 23 wherever it has a clearance between the discharge vessel 10 and the vessel-mounting part 23. However, the clearances d1, d2, and d3 do not have to be formed to be even, along the vessel-mounting part 23, as long as a predetermined position is maintained between the discharge vessel 10 and the induction coil 36.

The coupling of the discharge vessel 10 to the vessel-mounting part 23 is concretely performed as follows.

First, the protrusions 12 of the discharge vessel 10 is inserted into the groove 234 of the vessel-mounting part 23, until the side surface of the protrusion 12 comes into collision with a prevention wall 225 (the prevention wall 225 not shown in FIG. 7). Up to now, the procedure is the same as the one explained in the first embodiment, and the discharge vessel 10 is also rotated in a leftward direction as the first embodiment. However, the discharge vessel 10 in the present embodiment will not be held in a fixed position even when the side surface of the protrusion 12 comes into collision with the prevention wall 225. That is, the protrusion 12 of the discharge vessel 10 will be in such a condition that there is a clearance in every four direction in relation to the inner wall of the groove 234, even when the side surface of the protrusion 12 comes into collision with the prevention wall 225.

Next, the discharge vessel 10 and the bobbin 26 are respectively held by means of cramps for example. The cramps are then moved so that the induction coil 36 held by the coil-holding part 21 is placed in a predetermined position in relation to the hollow 13 of the discharge vessel 10. Such position arrangement of the induction coil 36 and the discharge vessel 10 is made possible thanks to the clearance generated between the protrusion 12 and the wall of the groove 234.

Finally, while maintaining the above positioning of the induction coil 36 in relation to the hollow 36, a heat resistance silicone is injected through a clearance generated between the neck portion 11 of the discharge vessel 10 (not shown in FIG. 7) and the wall 231 of the vessel-mounting part 23, then heated to be hardened. As a result, a silicone layer 53 is formed, through which the discharge vessel 10 and the bobbin 26 are held in a fixed position to each other.

In the above way, even when there are variations in sizes for the discharge vessel 10 or for the bobbin 26, such variation will be absorbed by the clearances d1, d2, and d3 generated between the protrusion 12 and the groove 234. This will realize coupling between the induction coil 36 and the discharge vessel 10, with high positioning accuracy. In particular, the discharge vessel 10, being produced by heating glass, has a greater possibility of generating variations in size, compared to the other parts. Therefore the electrodeless fluorescent lamp 2 that has the above-described structure is excellent in terms of achieving positioning accuracy between the induction coil 36 and the hollow 13 of the discharge vessel 10.

Therefore, it can be said that the electrodeless fluorescent lamp 2 compares favorably with the electrodeless fluorescent lamp 1 in that the electrodeless fluorescent lamp 2 also achieves such as the uniform luminous performance, superior level of safety, just as the electrodeless fluorescent lamp 1. In particular, the electrodeless fluorescent lamp 2 attains a constant luminous performance without depending on variations in sizes of the discharge vessel 10.

In addition, the production of the electrodeless fluorescent lamp 2 allows a wider range of sizes in parts, compared to the production of the electrodeless fluorescent lamp 1, since the clearances d1, d2, and d3 are able to absorb the variations in size of the discharge vessel 10, the bobbin 26, and the other parts. That is, the electrodeless fluorescent lamp 2 will need only a minimum level of size accuracy in the production of the parts, which is an advantage in terms of productivity, as well as from a cost point of view.

Further, the electrodeless fluorescent lamp 2 has a silicone layer 53 between the discharge vessel 10 and the bobbin 26. This is another excellent feature that it has insulation reliability, compared to such lamps as the electrodeless fluorescent lamp 1 in which the parts have been directly coupled.

Note that for the bobbin 26 already mentioned, the groove bottom 229 may be formed in a taper shape as shown in FIG. 5, or may not be formed in a taper shape. Likewise, the width direction of the groove 234 (i.e. height direction in FIG. 7) may be formed in a taper shape, or may not.

In addition, in the above description, a silicone layer 53 as a thermosetting resin layer is provided in a passage formed between the discharge vessel 10 and the vessel-mounting part 23. However, the layer to be provided in such passage is not confined to a layer made of silicone; a layer made of such as epoxy resin will also work.

(Other Things to Remember)

Note that in both of the first and second embodiments, only one type of electrodeless fluorescent lamps is taken as one example. However, the present invention is also applicable to electrodeless discharge lamps in general, such as electrodeless fluorescent lamps whose induction coil is formed on an outer surface of the discharge vessel, and high intensity discharge lamps (H.I.D.).

Furthermore, in the above description, the electrodeless fluorescent lamp 1 taken as an example includes the bobbin 20 that is made of a polyphenylene sulfide (PPS) resin, and a mixture of mercury and a rare-gas is enclosed in its discharge vessel. However, not to mention, the mentioned features are not essential to the present invention.

Furthermore, in the above embodiments, the circuit mounting member is mounted to the heat sink member 30. However, the mounting place may be at the undersurface of the bobbin 20, or of the bobbin 26. Or, the circuit mounting member and the bobbin 20 (or the bobbin 26) may be formed as a single piece.

In the above described electrodeless fluorescent lamp 1, the groove bottom 229 in the vessel-mounting part 22 is formed to have a taper form, which works to reduce the clearance between the protrusion 12 and the groove bottom 229, as the discharge vessel 10 is rotated in relation to the vessel-mounting part 22. Optionally, the side wall of the groove 224 (i.e. height direction of the groove 224) may further be formed to have a taper form, which facilitates the positioning of the discharge vessel in relation to the vessel-mounting part 22, not only in the axis-direction, but also in a direction perpendicular to the axis-direction. This will further improve the mounting-position accuracy.

In addition, in the above embodiments, the groove bottom 229 has a taper form which continuously reduces its depth. However, the present invention is not confined to this structure, as long as the groove bottom 229 is formed to have a shorter distance between the center of the vessel-mounting part in the diameter direction along its outer edge. For example, a structure is also possible in which both of the side wall and the groove bottom 29 will continuously approach the center of the vessel-mounting part 22 in the diameter direction.

In addition, if the groove bottom 229 in the vessel-mounting part 2 is not formed to have a taper form in the first embodiment, it becomes necessary to achieve a size accuracy between an inner wall of the vessel-mounting part 22 and the protrusion of the discharge vessel 10. Nevertheless, if the mentioned size accuracy is achieved in such a case, the same effect will be attained as stated in the above, compared to the conventional electrodeless discharge lamps.

In addition, in the above, the neck portion 11 of the discharge vessel 10 has, on its outer surface, four protrusions 12. However, the number and form of the protrusion are not limited to as described. For example, an external screw thread (left-hand thread) will equally do. Furthermore, the neck portion 11 may have a groove, instead of protrusions 12. In such a case, the same effect as that of the electrodeless fluorescent lamp 1 will be achieved, when the corresponding protrusion is provided for the vessel-mounting part, together with a cut-out portion so as to enable each protrusion of the vessel-mounting part to be freely inserted into the corresponding groove.

Still further, in the above description, the bobbin 20 includes the coil-holding part 21 and the vessel-mounting parts 22 or 23 that are formed as a single piece. However, these members may be formed independently first, then assembled together. In such a case, there will be more freedom at the production process. However, care is required, in assembling, so that the relative position between the parts will be kept accurate, and the parts after assembled should be coupled to each other tightly, without a chance of being separate, or rattling.

In addition, the protrusion 12 of the discharge vessel 10 is arranged to protrude outwardly in a diameter direction. However, the protrusion may be arranged to protrude inwardly in a diameter direction. In such a case, the vessel-mounting parts 22 and 23 are required to be formed to be able to receive the protrusion of the discharge vessel.

Still further, in the above, the ferrite core 35 is inserted into the bobbin 20, and into the bobbin 26. However, some electrodeless discharge lamps do not necessitate a ferrite core 35, depending on the frequency of the signal supplied to the coil. Therefore, the present invention may have the same effect, even without the ferrite core.

Still further, the order of each process at the production is not limited to the above described embodiments. For example, a process of coupling the discharge vessel 10 to the bobbin 20, 26 may be performed after the case 40 is fixed to the bobbin 20, 26.

Still further, in the second embodiment, injection of heat-resistance silicone is performed after a discharge vessel 10 has been coupled to the bobbin 26. However, the silicone may be injected in the groove 234 of the bobbin 26 before the discharge vessel 10 is coupled to the bobbin 26, so as to harden this silicone after the discharge vessel 10 has been inserted into the bobbin 26 and after the position of the discharge vessel 10 has been decided in relation to the bobbin 26. In other words, the silicone may be injected, before the protrusion 12 of the discharge vessel 10 is inserted into the groove 234 of the bobbin 26.

Although the present invention has been fully described by way of examples with references to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An electrodeless discharge lamp comprising:

a translucent discharge vessel in which a discharge gas is enclosed, the discharge vessel having a first coupling member;

an induction coil; and a bobbin that includes a coil-holding part and a vessel-mounting part that are formed as a single piece, the vessel-mounting part having a second coupling member, wherein the coil-holding part holds the induction coil on an outer surface thereof, and is placed in a proximity of the discharge vessel, and the first coupling member and the second coupling member are coupled so as to mount the discharge vessel on the vessel-mounting part of the bobbin.

2. The electrodeless discharge lamp of claim 1, wherein one of the first coupling member and the second coupling member is a protrusion, and the other is a groove that is shaped to receive the protrusion.

3. The electrodeless discharge lamp of claim 2, wherein the discharge vessel is coupled to the vessel-mounting part, so that the discharge vessel is held in a fixed position.

4. The electrodeless discharge lamp of claim 3, wherein the vessel-mounting part is a shallow dish and has a bottom, the second coupling member being the groove and being formed along an inner wall of the shallow dish.

5. The electrodeless discharge lamp of claim 4, wherein a portion is cut away from a wall portion that forms the groove, so as to enable the protrusion of the discharge vessel to be freely inserted into the groove.

6. The electrodeless discharge lamp of claim 5, wherein a distance between a groove bottom and a center of the vessel-mounting part continuously decreases in a diameter direction, the groove bottom being a part of an inner surface of the bottom that is under the groove, and the protrusion of the discharge vessel is guided toward a center of the vessel-mounting part in a diameter direction by being rotated along the groove bottom, so as to eventually hold the discharge vessel in a fixed position.

7. The electrodeless discharge lamp of claim 5, wherein the groove is formed along the inner wall so as to continuously decrease in height, and the protrusion of the discharge vessel is guided toward a height direction of the groove formed on the vessel-mounting part, by being rotated along the part of the inner wall, so as to eventually hold the discharge vessel in a fixed position.

8. The electrodeless discharge lamp of claim 6, wherein the discharge vessel is rotated leftward when the vessel-mounting part is seen from the discharge vessel.

9. The electrodeless discharge lamp of claim 2, wherein the discharge vessel is coupled to the vessel-mounting part, having a resin member between the protrusion and the groove.

10. The electrodeless discharge lamp of claim 1, wherein the vessel-mounting part fixes the bobbin to a case, the case including a connection part that electrically connects the bobbin to an external circuit.

11. The electrodeless discharge lamp of claim 10, wherein a driving circuit that drives the induction coil is provided in a space between the vessel-mounting part and the case.

12. The electrodeless discharge lamp of claim 1, wherein a light-reflective layer is formed on an area of the induction coil, the area opposing the discharge vessel.

13. The electrodeless discharge lamp of claim 1, wherein a phosphor layer is formed on an inner surface of the discharge vessel.

14. The electrodeless discharge lamp of claim 7, wherein the discharge vessel is rotated leftward when the vessel-mounting part is seen from the discharge vessel.

15. An electrodeless discharge lamp comprising:

a translucent discharge vessel in which a discharge gas is enclosed, the discharge vessel having a first coupling member integrally formed as a set of a plurality of diametrically outwardly projecting protrusions;

an induction coil; and a bobbin that includes a coil-holding part and a vessel-mounting part that are formed as a single piece, the vessel-mounting part having a second coupling member including a plurality of spaced overhanging walls, each wall of a configuration to engage a respective protrusion;

wherein the coil-holding part holds the induction coil on an outer surface thereof, and is placed in a proximity of the discharge vessel, and the first coupling member and the second coupling member are coupled together so as to mount the discharge vessel on the vessel-mounting part of the bobbin.

* * * * *